United States Patent [19]

Bond et al.

[11] 4,146,190

[45] Mar. 27, 1979

[54] WEB WINDING CONTROL SYSTEM

[75] Inventors: Robert W. Bond, Greenville; John Z. Robinette, Jr., Spartanburg, both of S.C.

[73] Assignee: Bond Textile Machinery, Inc., Greenville, S.C.

[21] Appl. No.: 857,588

[22] Filed: Dec. 2, 1977

[51] Int. Cl.[2] ..... B65H 59/00

[52] U.S. Cl. ..... 242/75.51; 242/66

[58] Field of Search ..... 242/75.51, 75.5, 75.52, 242/75.53, 66

[56] References Cited

U.S. PATENT DOCUMENTS

| | | | |
|---|---|---|---|
| 1,455,976 | 5/1923 | Stevens | 242/75.5 |
| 2,353,408 | 7/1944 | Larsen | 242/75.51 |
| 2,739,762 | 3/1956 | Cohn | 242/75.5 |
| 3,810,589 | 5/1974 | Mousseau | 242/75.51 |
| 4,025,009 | 5/1977 | Finco | 242/75.5 |

*Primary Examiner*—Edward J. McCarthy

*Attorney, Agent, or Firm*—Mason, Fenwick & Lawrence

[57] ABSTRACT

A web roll winder is driven by a variable torque output motor controlled by a spring biased dancer roll over which the web passes prior to winding; the dancer roll adjusts motor control means in response to the tension in the web for varying the torque output of the variable torque output motor for maintaining tension in the web within a desired range.

9 Claims, 6 Drawing Figures

WEB WINDING CONTROL SYSTEM

This invention is in the field of winding and reeling and is specifically directed to power driven web take-up means of the type of particular use in winding the output of a loom onto a take-up roll.

Previously known web take-up roll drive systems have employed main drive motors of the type having a variable torque output under the manual control of the operator. It has been the practice in the past for the operator to monitor the operation and make necessary adjustments in the motor output torque of the drive motor in accordance with the observed roll condition. Unfortunately, improper tension does not always become visually apparent immediately and is consequently frequently undetected for a substantial time period until such time as the roll condition makes is apparent. Another drawback of the presently known systems is the requirement for the continuous presence of the operator to monitor the system so as to entail substantial labor costs; moreover, the finished rolls frequently vary from each other and in different parts of a given roll due to human error and different operating procedures and judgments of different workers.

Therefore, it is the primary object of this invention to provide a new and improved web roll drive means.

A further object of the invention is the provision of a new and improved loom take-up roll drive having automatic tension control features.

Achievement of the foregoing objects is enabled by the preferred embodiment of the invention by the employment of a dancer idler roll mounted in the lower ends of spaced swing arms with each swing arm being pivotally supported at its upper end for pivotal movement about a horizontal pivot support shaft. The moving web from the loom or other source is fed over the dance idler roll and then moves upwardly between a pair of support and driving rolls on which the take-up roll is positioned and supported for receiving the web. The support and driving rolls are driven in a well-known manner and tension in the web being fed over the dancer roll serves to pivot the dancer roll and its supporting swing arms against the bias of spring means with the pivotal movement being detected by sprocket and chain drive from the horizontal pivot support shaft means of the dancer roll which is connected to a variable transformer to effect a voltage variation in the power provided the main drive motor of the device. When the tension in the web increases above the predetermined level, the power to the drive motor is reduced and alternatively upon a decrease in tension, the power to the drive motor is increased. Consequently, tension in the fabric web is maintained at a substantially constant desired level so as to permit the formation of a uniform fabric roll by operation of the device.

A better understanding of the manner in which the preferred embodiment achieves the foregoing objects will be enabled when the following written description is considered in conjunction with the appended drawings in which.

Figure 1:
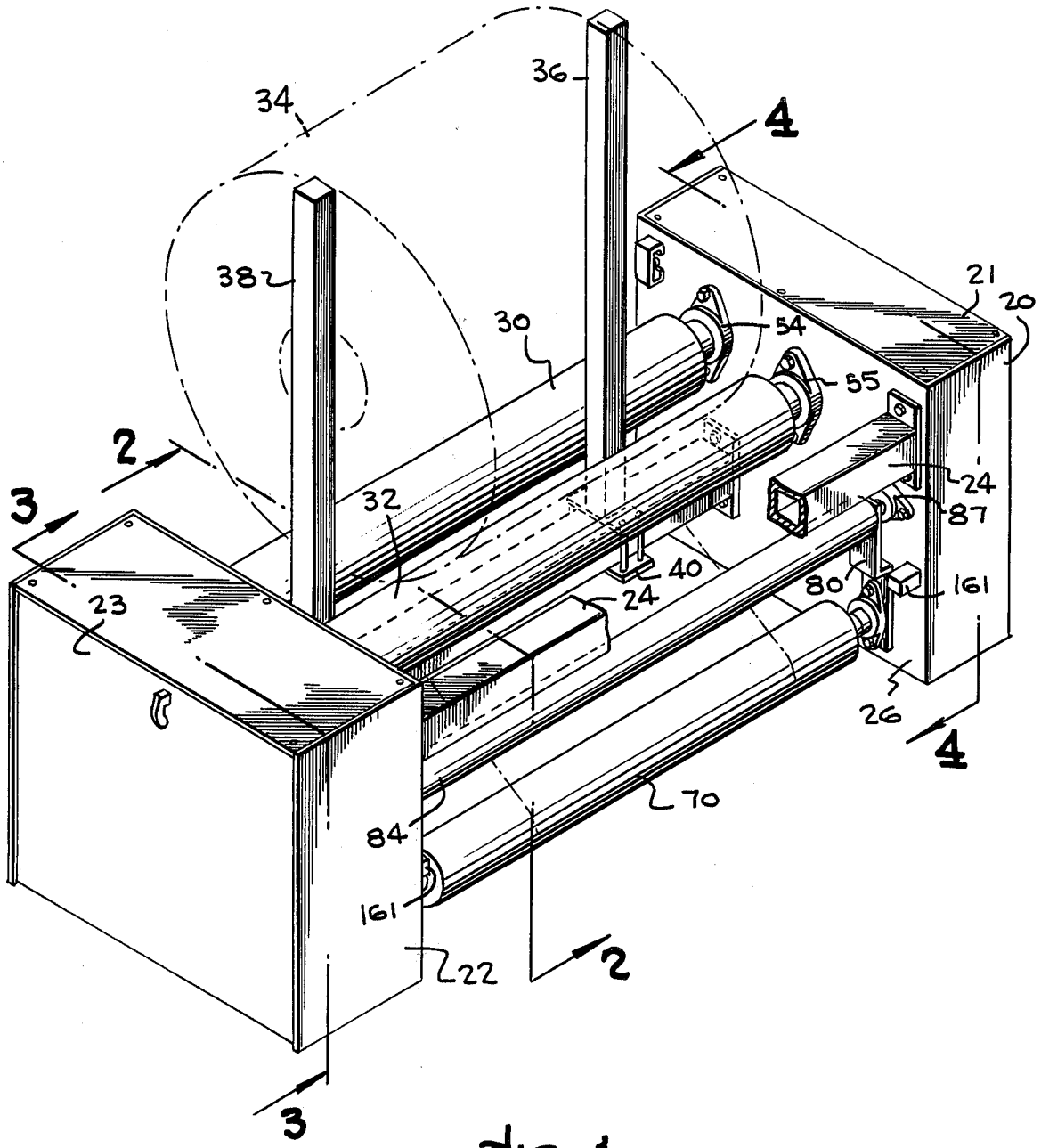
FIG. 1 is a perspective view of the preferred embodiment of the invention.
Figure 5:
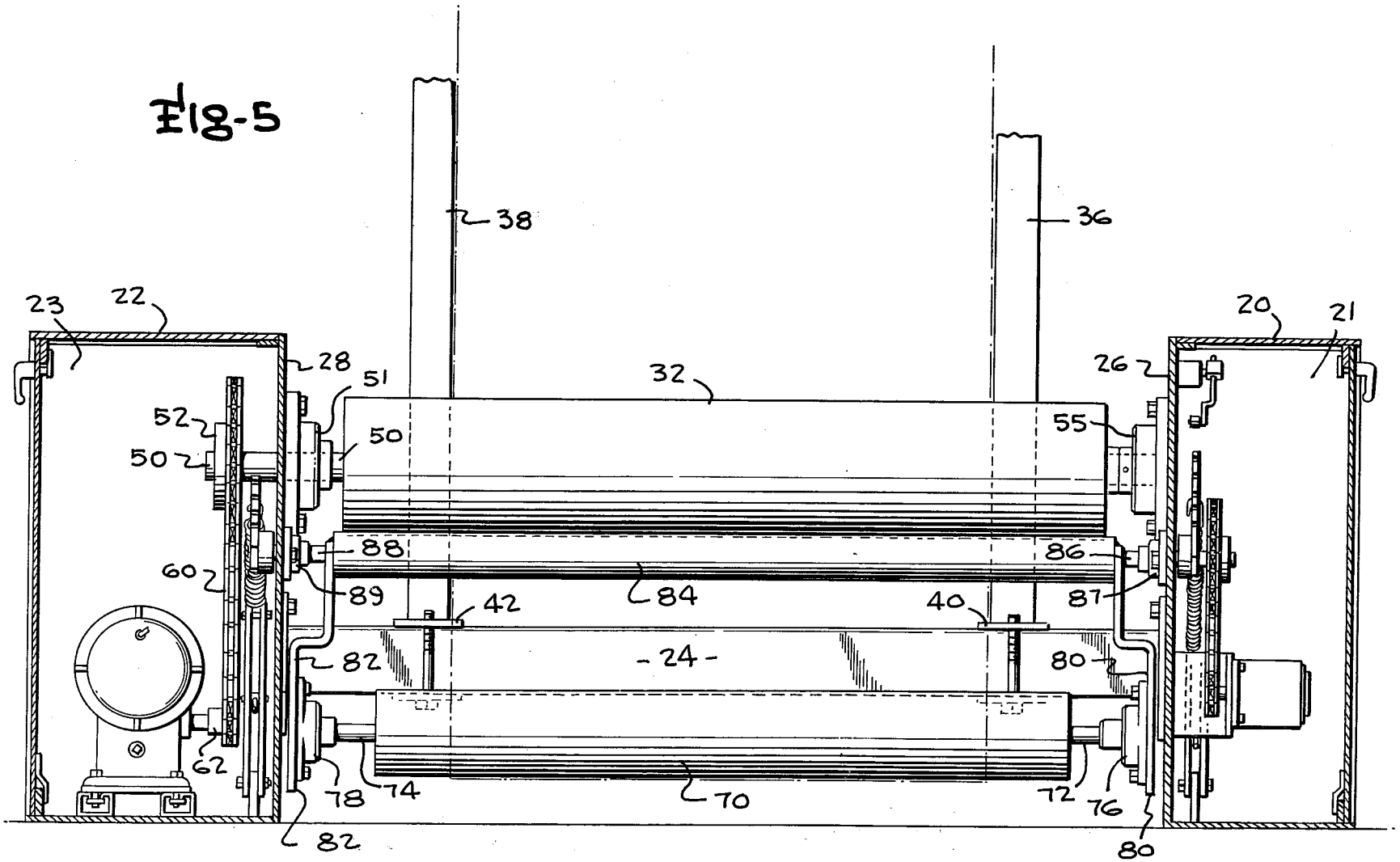
FIG. 5 is a sectional view taken along lines 5—5 of FIG. 2.

Attention is initially invited to FIGS. 1 and 5 of the drawings which illustrate the primary components of the preferred embodiment and which include first and second rigid housings 20 and 22 having removable end panels 21 and 23 and connected by a transverse cross bar 24 which cooperate to define the supporting framework for the remaining components of the assembly. More specifically, first and second housings 20 and 22 respectively include inwardly facing rigid walls 26 and 28 in which a plurality of rotary bearings are provided for supporting a pair of horizontally spaced and axially parallel support and drive rolls 30 and 32 on which a web take-up roll 34 illustrated in phantom lines in FIG. 1 is supported. First and second roll edge guide posts 36 and 38 are respectively mounted on the transverse cross bar 24 by slider clamps 40 and 42 which permit the guide posts to be clamped in adjusted position adjacent the ends of the web take-up roll 34 in an obvious manner.

Figure 3:
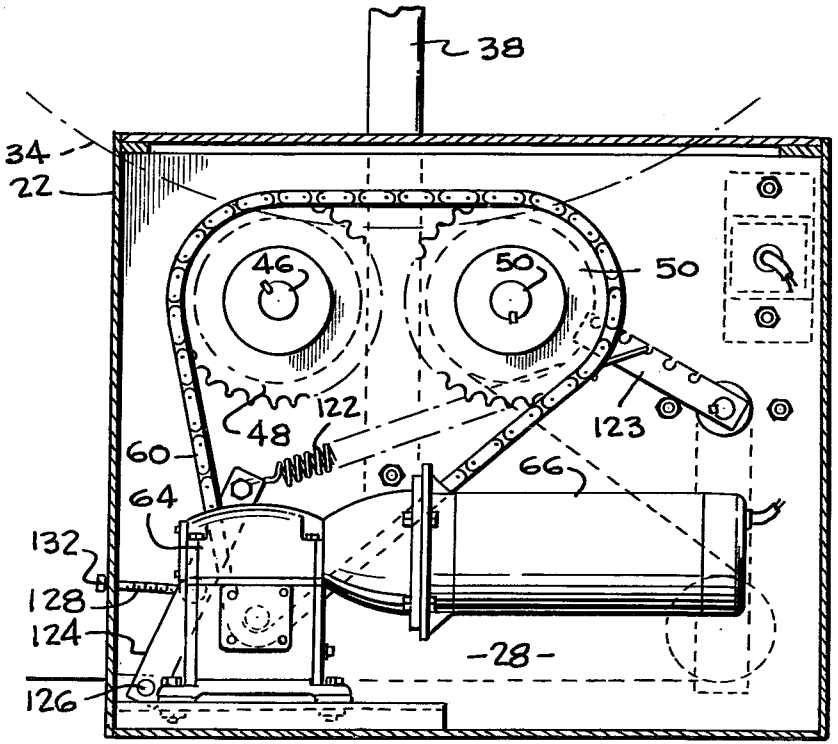
FIG. 3 is a sectional view taken along lines 3—3 of FIG. 1.

A stub shaft 46 extends from the end of support and drive roll 30 through bearing means mounted on inwardly facing wall 28 and has a sprocket 48 (FIG. 3) keyed to its end portion within the interior of housing 22. Similarly, a stub shaft 50 extends from the end of support and drive roll 32 through bearing means 51 mounted on the inwardly facing wall 28 and has a sprocket 52 keyed to its end portion within the interior of the housing 22. The opposite ends of the support and drive rolls 30 and 32 are respectively provided with similar stub shafts received in bearings 54 and 55 mounted on the inwardly facing wall 26 of housing 20 as shown in FIG. 1.

A drive chain 60 is drivingly positioned on the sprockets 48 and 52 and also extends about an output sprocket 62 of a stepdown transmission 64 having an input driven by a variable torque output motor 66. It should be observed that the power from motor 66 effects a driving rotation of the support drive rolls 30 and 32 in a clockwise direction so as to rotate the web take-up roll 34 in a counter-clockwise direction as viewed in FIG. 2.

A dancer roll 70 has stub shafts 72 and 74 extending from opposite ends and mounted in bearings 76 and 78 respectively carried on the lower ends of swing arms 80 and 82. The upper ends of swing arms 80 and 82 are welded to the end of an arm support sleeve or shaft 84 with stub shafts 86 and 88 respectively extending from the ends of sleeve 84 through the swing arms 80 and 82 into rotary support bearings 87 and 89 respectively provided on the inwardly facing walls 26 and 28 of the first and second housings 20 and 22. Consequently, it will be seen that the dancer roll 70 is capable of bodily pivotal movement about the common axis of stub shafts 86 and 88 and is also capable of rotation about the common axis of stub shafts 72 and 74.

Figure 2:
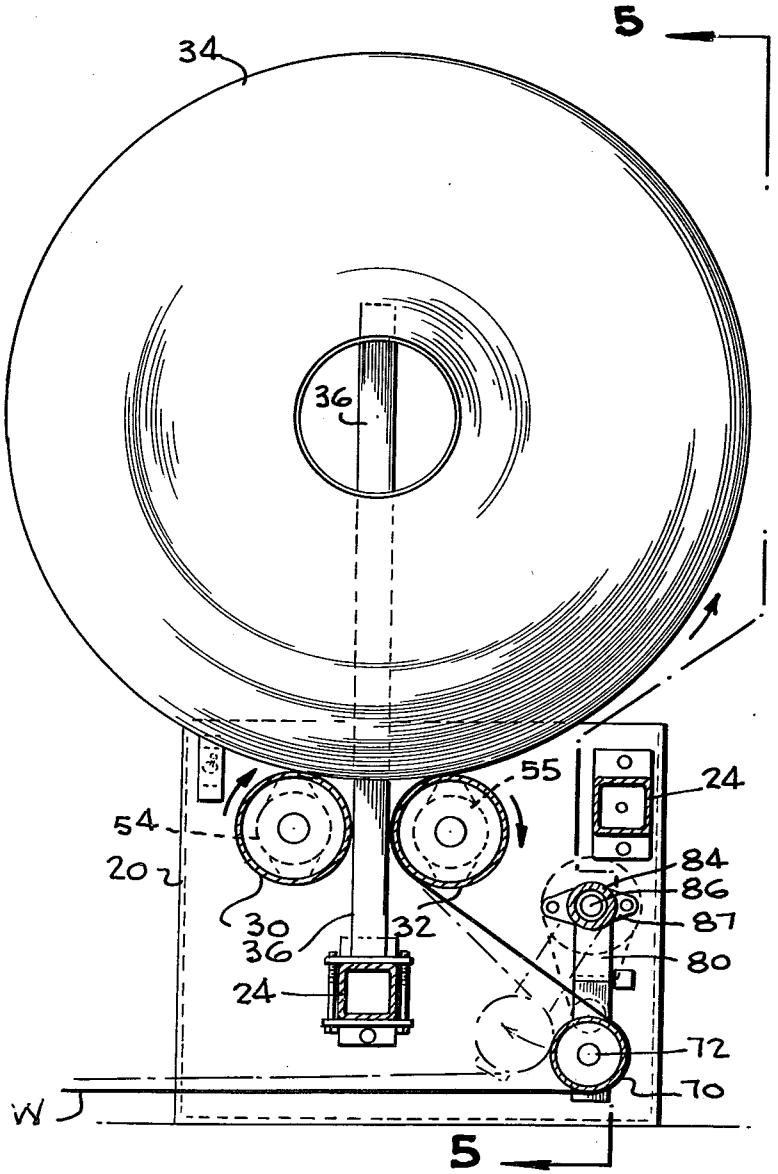
FIG. 2 is a sectional view taken along lines 2—2 of FIG. 1.
Figure 6:
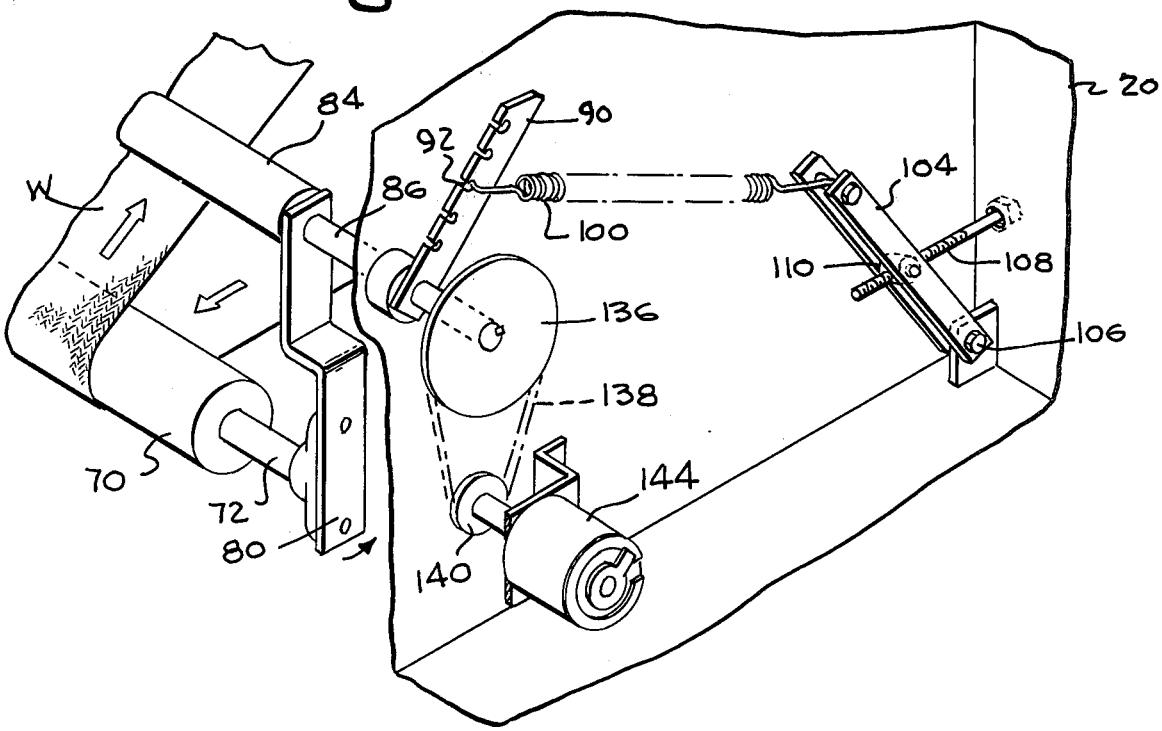
FIG. 6 is a perspective view of a portion of the control means of the invention.

However, means are provided for urging the dancer roll to the right as illustrated in FIGS. 1 and 2; this means includes another lever arm 90 which is keyed to the end of stub shaft 86 on the interior of housing 20 and a tension spring 100 which has one end portion connected in one of the notches 92 of the notched lever arm with the opposite end of the spring 100 being connected to an adjustable pivot lever 104. Lever 104 is normally held in a stationary position but is mounted for pivotal adjustment about a pivot pin 106 as best shown in FIG. 6. A threaded rod 108 extends through a threaded fitting 110 pivotally attached to the adjustable pivot lever 104 with a knob 114 being positioned on the outer end of the threaded rod externally of the housing 20. Consequently, it will be appreciated that rotation of the knob 114 effects an adjustment of the angular position of the lever 104 about pivot pin 106 to consequently adjust the tension in spring 100.

Similarly, housing 22 includes essentially identical biasing means for stub shaft 88 including a tension spring 122, an adjustable pivot lever 124, pivot pin 126, threaded rod 128 and adjustment knob 132 identical to the components 104, 106, 108 and 114 etc. provided in the housing 20 in conjunction with the stub shaft 86. Consequently, both swing arms 80 and 82 are biased by a like amount of force acting in opposition to the tension in a cloth web W extending about dancer roll 70.

A sprocket 136 is keyed to the end of stub shaft 86 and a chain 138 extends about the sprocket 136 and is also positioned on a sprocket 140 keyed to the rotary control shaft of a variable output transformer or potentiometer 144 connected by conductor means to the variable torque output motor 66 for varying the torque output of the motor in a well-known manner in accordance with the rotary position of the rotary control shaft of the transformer.

The cloth web W is supplied from the output of a web supply source such as a loom and extends about the dancer roll 70 and then upwardly about the support and drive roll 32 at which it merges with the web take-up roll 34.

Figure 4:
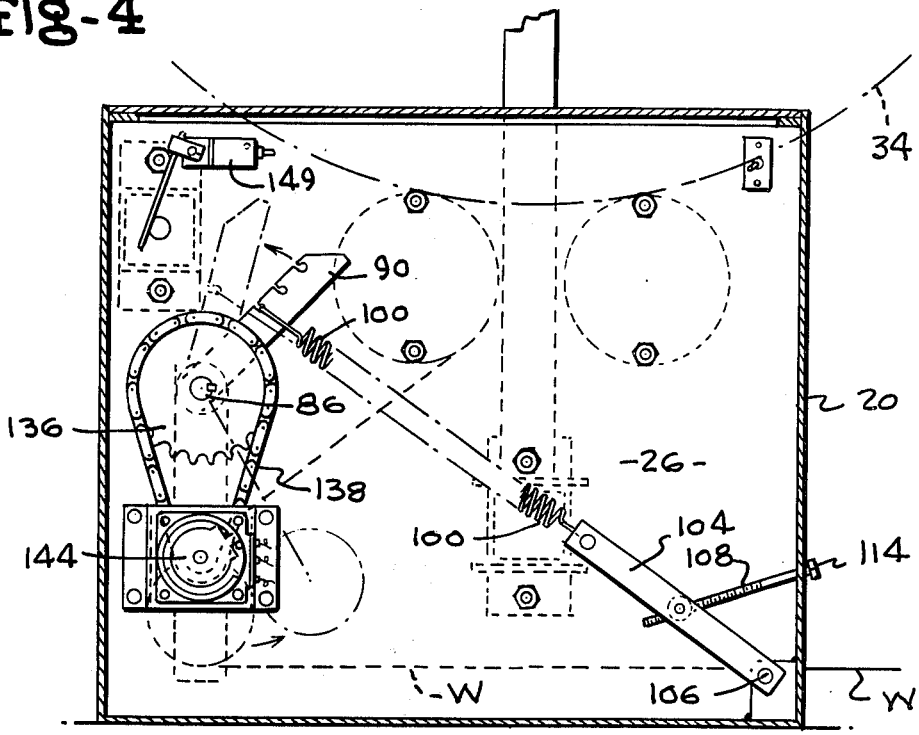
FIG. 4 is a sectional view taken along lines 4—4 of FIG. 1.

It will be appreciated that the tension in web W acts against the tension in springs 100 and 122 so that an increase in tension in the web serves to pivot the lever 90 toward the dashed position of FIG. 4 in a counterclockwise direction which results in a consequent adjustment of the variable output transformer to reduce the output voltage of the transformer and to also reduce the torque of the drive motor 66 and consequently reduce the tension in the web W to maintain it within a desired tension range. In a similar manner, a decrease in tension in the web W below the desired level permits the springs 100 and 122 to pivot their associated lever arms in an opposite direction to effect an increase in the output torque of the motor to keep the desired web tension rabge. A limit switch 149 is positioned to be engaged by lever arm 90 in the event of overly high web tension to terminate power to the drive motor. Stop means 161 limits movement of arms 80 and 82 in the reverse direction such as when there is no web in the machine.

Numerous modifications of the preferred embodiment will undoubtedly occur to those of skill in the art and it should therefore be understood that the spirit and scope of the invention is to be limited solely by the appended claims.

We claim:

1. A web winding apparatus comprising a variable torque output motor, roll drive means drivingly engaged with a web take-up roll for rotating the take-up roll to effect the winding of a web thereon, power transmission means drivingly connecting said variable torque output motor to said roll drive means, web infeed means for directing a web from a web source to said web take-up roll and control means responsive to the tension in the web portion between the web source and the take-up roll for varying the torque output of said variable torque output motor for maintaining tension in said web portion within a desired range.

2. The invention of claim 1 wherein said control means includes a dancer roll, said web portion being directed about a substantial portion of the periphery of said dancer roll, movable roll support means supporting said dancer roll for bodily displacement, a variable output transformer having an adjustable input member the position of which determines the output voltage of said transformer, conductor means connecting the output of said transformer to said variable torque output motor for effecting a variation in the torque of said motor upon variation in the output of said transformer and mechanical connection means between said movable roll support means supporting said dancer roll and the adjustable input of said voltage output transformer for changing the output voltage of said variable output transformer in response to bodily displacement of said dancer roll caused by variations in the tension of the web portion.

3. The invention of claim 1 wherein said control means includes a dancer roll, said web portion being fed about said dancer roll, swing arm means supporting said dancer roll for pivotal bodily displacement, a variable output transformer having an adjustable input member the position of which determines the output voltage of said transformer, conductor means connecting the output of said transformer to said variable torque output motor for effecting a variation in the torque of said motor upon variation in the output of said transformer and chain drive means extending between said swing arm means supporting said dancer roll and the adjustable input of said voltage output transformer for changing the output voltage of said variable output transformer in response to bodily displacement of said dancer roll caused by variations in the tension of the web portion.

4. The invention of claim 3 wherein said swing arm means are supported on and fixedly connected to pivot shaft means and additionally including biasing means connected to said pivot shaft means for applying a force to said pivot shaft means urging said pivot shaft means to rotate in a direction causing movement of said dancer roll tending to increase tension in said web portion.

5. The invention of claim 4 additionally including means for adjusting the amount of force exerted by said biasing means on said pivot shaft means.

6. The invention of claim 1 wherein said roll drive means includes first and second parallel horizontal support and drive rolls on which said web take-up roll is supported and chain drive means drivingly connecting said first and second parallel horizontal support and drive rolls to said variable torque output motor.

7. The invention of claim 6 wherein said control means includes a dancer roll, said web portion being first fed about a portion of said dancer roll in which the web portion effects a substantial change in direction and then being fed over a substantial portion of one of said horizontal support and drive rolls to merge into said web take-up roll, swing arm means supporting said dancer roll for pivotal bodily displacement, a variable output transformer having an adjustable input member the position of which determines the output voltage of said transformer, conductor means connecting the output of said transformer to said variable torque output motor for effecting a variation in the torque of said motor upon variation in the output of said transformer and chain drive means extending between said swing arm means supporting said dancer roll and the adjustable input of said voltage output transformer for changing the output voltage of said variable output transformer in response to bodily displacement of said dancer roll caused by variations in the tension of the web portion.

8. The invention of claim 7 wherein said swing arm means are supported on and fixedly connected to pivot shaft means and additionally including biasing means connected to said pivot shaft means for applying a force to said pivot shaft means urging said pivot shaft means to rotate in a direction causing movement of said dancer roll tending to increase tension in said web portion.

9. The invention of claim 8 additionally including means for adjusting the amount of force exerted by said biasing means on said pivot shaft means.

* * * * *